US011700964B2

(12) United States Patent
Zuchel, Jr.

(10) Patent No.: US 11,700,964 B2
(45) Date of Patent: Jul. 18, 2023

(54) APPARATUS FOR HANGING CURTAIN RODS AND A METHOD OF INSTALLING THE SAME WITHOUT FASTENERS

(71) Applicant: Robert Joseph Zuchel, Jr., Annandale, VA (US)

(72) Inventor: Robert Joseph Zuchel, Jr., Annandale, VA (US)

( * ) Notice: Subject to any disclaimer, the term of this patent is extended or adjusted under 35 U.S.C. 154(b) by 416 days.

(21) Appl. No.: 16/948,555

(22) Filed: Sep. 23, 2020

(65) Prior Publication Data

US 2022/0087467 A1 Mar. 24, 2022

(51) Int. Cl.
*A47H 1/14* (2006.01)
*A47H 1/142* (2006.01)

(52) U.S. Cl.
CPC ..... *A47H 1/142* (2013.01)

(58) Field of Classification Search
CPC ..... A47H 1/142; A47H 2001/021
See application file for complete search history.

(56) References Cited

U.S. PATENT DOCUMENTS 928,190 A * 7/1909 Flynn ..... A47H 1/142 248/263
1,015,879 A * 1/1912 Escher ..... A47H 1/13 248/258
1,056,384 A 3/1913 Umstaetter
1,216,592 A 2/1917 Mors
1,525,895 A * 2/1925 Sherwood ..... A47H 1/13 248/254
2,140,663 A * 12/1938 Bailey ..... D06F 57/00 248/220.21
2,151,223 A 3/1939 Nayman, Sr.
3,704,851 A 12/1972 Cormier
4,283,034 A 8/1981 Sheehan
4,322,050 A * 3/1982 Roach ..... A47H 1/122 248/265
4,335,865 A * 6/1982 Cormier ..... A47H 13/04 248/216.1
4,724,883 A * 2/1988 Liebowitz ..... E06B 9/36 160/84.01
4,961,296 A 10/1990 Morehouse
4,964,604 A 10/1990 Lombard
D331,360 S * 12/1992 Adams ..... A47H 1/13 24/711.4
6,182,933 B1 * 2/2001 Rapp ..... E04D 13/00 248/231.81
6,216,889 B1 * 4/2001 Chang ..... A47H 1/142 248/262

(Continued)

*Primary Examiner* — Amy J. Sterling
(74) *Attorney, Agent, or Firm* — Dunlap Bennett & Ludwig, PLLC

(57) ABSTRACT

An apparatus for hanging curtains without tools and wherein no damage is done to the outer wall surface nor, in certain embodiments, the window framing. The apparatus has a wedge body with a first hook at the heel end of the wedge body, and in certain embodiments, the wedge body has a second hook between its heel end and toe end along its inclined plane. The toe end can be wedged between the head of the window framing and intrinsic support typically found adjacent the head of the window framing, like a tension rod or the like. This wedge supports the first and second hooks which protrude from the window framing space for hanging curtain rods therefrom.

8 Claims, 4 Drawing Sheets

(56) References Cited

U.S. PATENT DOCUMENTS

| | | | | |
|---|---|---|---|---|
| 6,345,796 | B1 * | 2/2002 | Neuman | A47G 29/083 248/227.2 |
| 8,418,975 | B1 | 4/2013 | Burr | |
| 9,609,974 | B2 | 4/2017 | Mateer | |
| 9,743,791 | B2 | 8/2017 | Haynesworth | |
| 10,064,512 | B2 | 9/2018 | McMillion | |
| 10,123,647 | B1 | 11/2018 | Mustafa | |
| 10,376,086 | B1 | 8/2019 | Mustafa | |
| 10,542,835 | B1 * | 1/2020 | Suozzo | A47H 1/102 |
| 11,452,398 | B2 * | 9/2022 | Berman | A47H 1/142 |
| 2018/0255952 | A1 | 9/2018 | Sollers | |
| 2019/0282017 | A1 | 9/2019 | Hanley et al. | |

* cited by examiner

APPARATUS FOR HANGING CURTAIN RODS AND A METHOD OF INSTALLING THE SAME WITHOUT FASTENERS

BACKGROUND OF THE INVENTION

The present invention relates to devices for and methods of hanging curtains and, more particularly, an apparatus for hanging curtains and curtain rods without additional tools and/or without visually damaging the window framing, and a method of using the same.

Current curtain hangers require tools for installation, such as a nails and screws and a hammer or screwdriver to drive the fasteners. Not everyone uses tools very well and so this can lead to a user damaging the window frames or surrounding walls they intend on making more aesthetically pleasing by hanging curtains. The small size of the typical nails or screws used to install curtain rods are the usual culprit as they can be hard to handle.

As can be seen, there is a need for an apparatus for hanging curtains and curtain rods without additional tools and/or without damaging the window framing and especially the surround wall, and a method of using the same.

The present invention (colloquially known as "The Curtain Shim") utilizes support from intrinsic fixtures, such as installed window blinds or tension rods, and thereby obviating the need for fasteners and the tools used to implement them. In short, the present invention embodies a one-step installation apparatus that needs no tools, no measurements, and no special knowledge or expertise to use.

SUMMARY OF THE INVENTION

In one aspect of the present invention, an apparatus for hanging curtains adjacent a periphery of a window framing includes the following: a wedge body extending between a heel end and a toe end; the wedge body defined by an inclined surface and a planar surface opposing the inclined surface; and a first hook connected to the heel end, the first hook facing an upward direction while the inclined surface faces a downward direction.

In another aspect of the present invention, the apparatus for hanging curtains adjacent a periphery of a window framing includes the following: wherein the first hook is connected at an interface of the inclined surface and the heel end, wherein the first hook is connected at an interface of the planar surface and the heel end; a second hook between the heel end and the toe end, the second hook facing the upward direction, wherein the second hook extends from the inclined surface; a hole between the heel end and the toe end, the hole communicating the planar surface and the inclined surface; two longitudinal sidewalls extending from the inclined surface, wherein the planar surface comprises each distal edge of the two longitudinal sidewalls defines the planar surface, and wherein the wedge body is substantially a void between the inclined surface and the longitudinal sidewalls; and a raised reinforcement surrounding the hole.

In yet another aspect of the present invention, a method of installing a curtain rod hanger adjacent to a head of a window framing having intrinsic structure adjacent to said head, without using fasteners, the method includes the following: providing the above apparatus for hanging curtains adjacent a periphery of a window framing; and wedging the toe end between said head and said intrinsic structure, wherein said intrinsic structure is a tension rod or a window blind.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an apparatus for hanging curtains without tool and wherein no damage is done to the outer wall surface nor, in certain embodiments, the window framing. The apparatus has a wedge body with a first hook at the heel end of the wedge body, and in certain embodiments, the wedge body has a second hook between its heel end and toe end along its inclined plane. The toe end can be wedged between the head of the window framing and intrinsic support typically found adjacent the head, like a tension rod or the like. This wedge supports the first and second hooks which protrude from the window framing space for hanging curtain rods therefrom.

Figure 1:
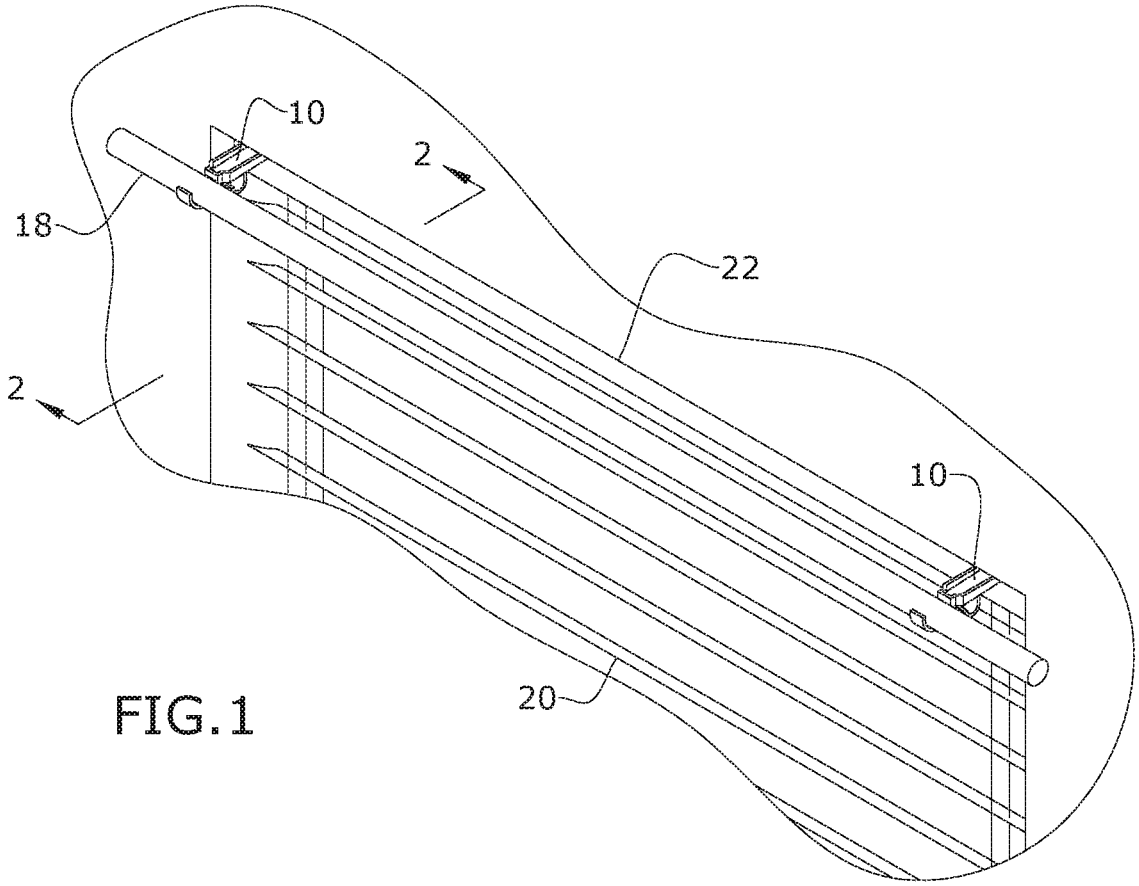
FIG. 1 is a perspective view of an exemplary embodiment of the present invention.
Figure 2:
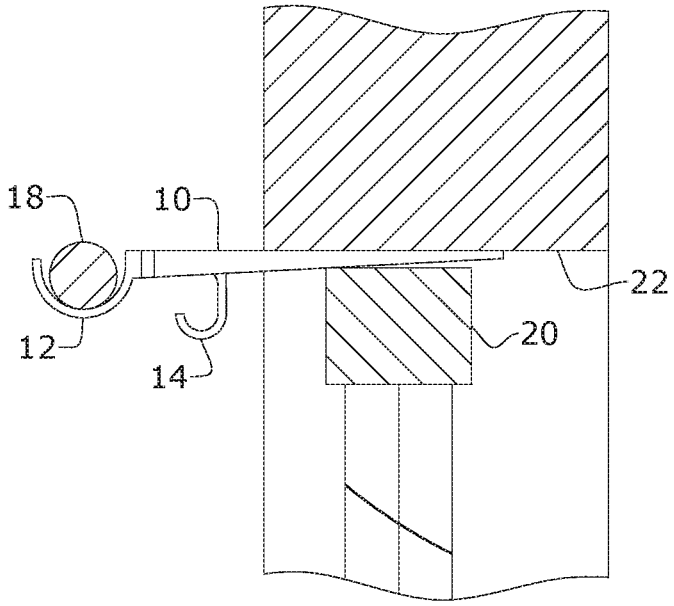
FIG. 2 is a section view of an exemplary embodiment of the present invention, taken along line 2-2 of FIG. 1.
Figure 3:
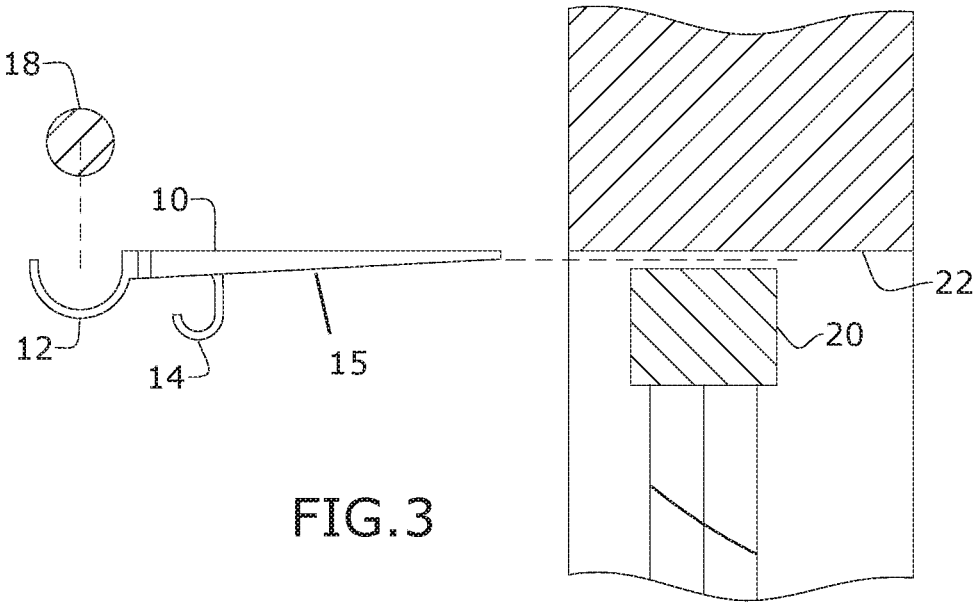
FIG. 3 is an exploded view of FIG. 2.
Figure 4:
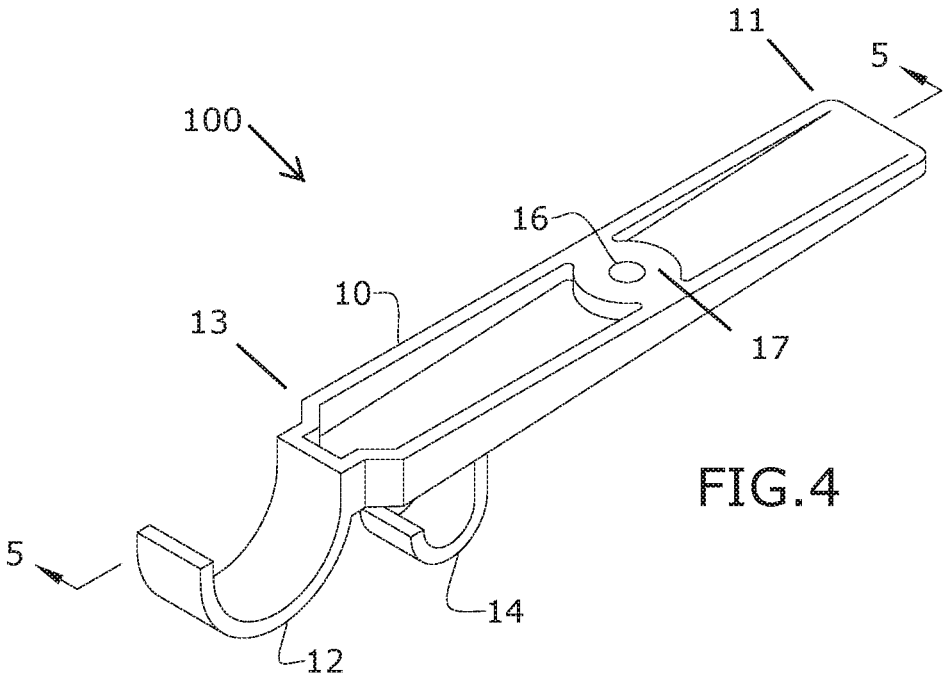
FIG. 4 is a top perspective view of an exemplary embodiment of the present invention.
Figure 5:
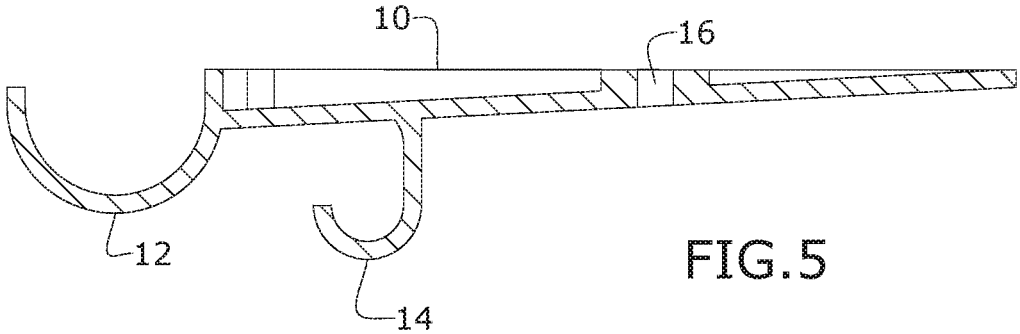
FIG. 5 is a section view of an exemplary embodiment of the present invention, taken along line 5-5 of FIG. 4.
Figure 6:
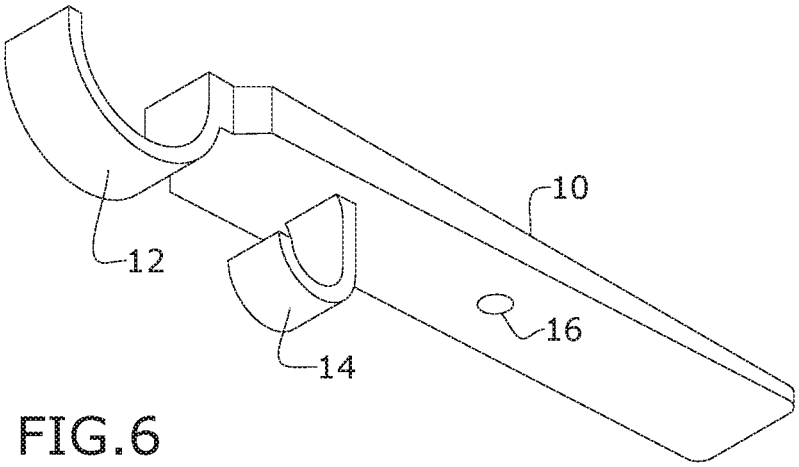
FIG. 6 is a bottom perspective view of an exemplary embodiment of the present invention.
Figure 7:
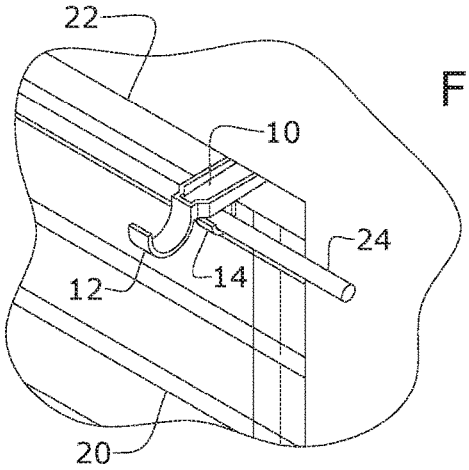
FIG. 7 is a partial perspective view of an exemplary embodiment of the present invention.

Referring now to FIGS. 1 through 9, the present invention may include an apparatus 100 for low-profile, low-impact hanging of curtains. The apparatus 100 may have a wedge portion 10 extending from a toe end 11 to a heel end 13. The wedge portion 10 may or may not be solid, but in certain embodiments may be generally carved out so that a cavity exists between the two longitudinal sides, as illustrated in FIG. 4.

A first hook 12 may extend from the heel end 13. In certain embodiments the first hook 12 may extend from the inclined plane 15 of the wedge portion 10, while in other embodiments the first hook could extend from adjacent the flat plane, opposing the inclined plane 15 (even though the Figures show only the former arrangement). A second hook 14 may extend from the inclined plane 15 between the toe end 11 and heel end 13.

Each hook 12 and 14 may be upward facing, as illustrated in the Figures. The first hook 12 may be bigger than the second hook 14, and so the first hook 12 is dimensioned to support a first rod 18, which would be larger than a second rod 24. The first and second rods 18 and 24 could be curtain rods; through, could be any elongated object a user needs support along an opening in a wall or other supporting structure.

Figure 9:
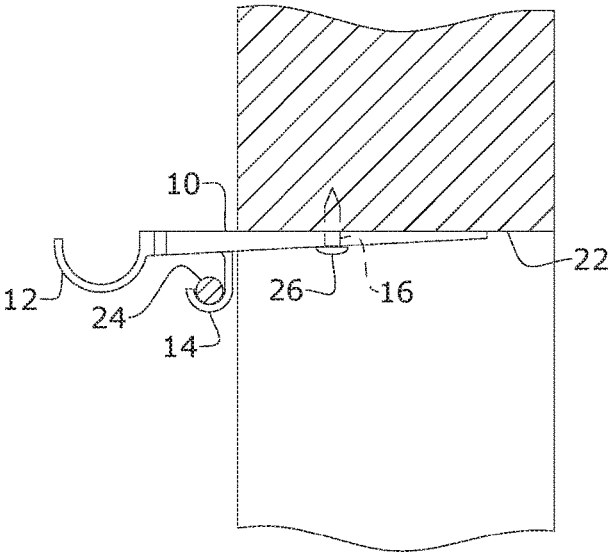
FIG. 9 is a section view of an exemplary embodiment of the present invention, illustrating use of a fastener when no intrinsic support is available; though it should be noted that the apparatus interfaces with the underside of the head of the window framing, and that no marks are left on the room-facing wall surrounding the window.

A hole 16 may be provided in the wedge portion 10 between the toe end 11 and heel end 13, wherein the hole 16 the communicates the inclined plane 15 with the flat plane. The hole 16 may be reinforced within the above-mentioned cavity by way of a reinforcement 17, which may be a raised portion of the molded apparatus 100, to support/reinforce the use of a fastener 26. The hole 16 may be utilized by a fastener 26, such as a screw, to connect the apparatus 100 to an inner surface of a window frame, such as the surface that defines an upper portion of the window framing, "the head" 22, as illustrated in FIG. 9. This discrete surface is far less likely to be visible as compared to room-facing wall that surrounds the window opening.

Figure 8:
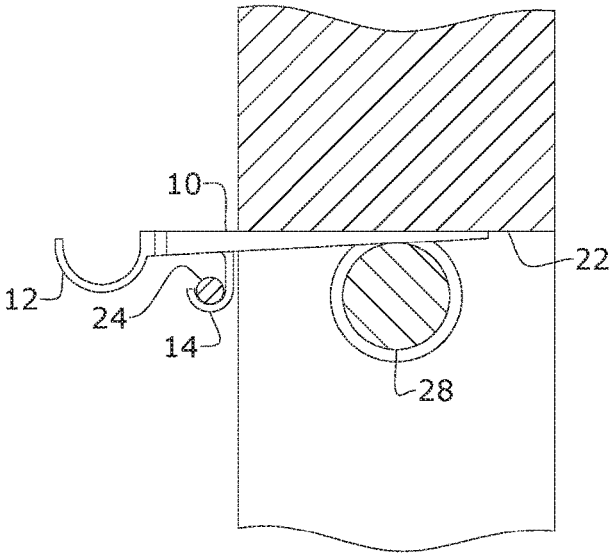
FIG. 8 is a section view of an exemplary embodiment of the present invention, illustrating use of intrinsic support that is a tension rod.

A method of using the present invention may include the following. The apparatus 100 disclosed above may be provided. A user would wedge, toe end 11 first, the wedge portion 10 between the head 22 and an intrinsic support 28, common to window framing, such as installed blinds or a tension rod, as illustrated in FIG. 8. The apparatus 100 being dimensioned so that the first and second hooks 12 and 14 protrude beyond the space defined by the window framing and, typically into a room space. As such the hooks 12 and 14 can be used for cradling different sized curtain rods 18 and 24, while being supported by the wedge portion 10 in a low-impact, low-profile manner. In situations without intrinsic support 28, the fastener 26 can be used through the hole 16 to fix the apparatus 100 to the head 22, as illustrated in FIG. 9, which is preferable to screwing or hammering into the surrounding wall.

It should be understood, of course, that the foregoing relates to exemplary embodiments of the invention and that modifications may be made without departing from the spirit and scope of the invention as set forth in the following claims.

What is claimed is:

1. An apparatus for hanging curtains adjacent a periphery of a window framing, comprising:

a wedge body extending between a heel end and a toe end;

the wedge body defined by an inclined surface and a planar surface opposing the inclined surface;

a first hook connected to the heel end, the first hook facing an upward direction while the inclined surface faces a downward direction;

second hook between the heel end and the toe end, the second hook facing the upward direction, wherein the second hook extends from the inclined surface;

a hole between the heel end and the toe end, the hole communicating the planar surface and the inclined surface; and two longitudinal sidewalls extending from the inclined surface, wherein the planar surface comprises each distal edge of the two longitudinal sidewalls defines the planar surface, and wherein the wedge body is substantially a void between the inclined surface and the longitudinal sidewalls.

2. The apparatus of claim 1, wherein the first hook is connected at an interface of the inclined surface and the heel end.

3. The apparatus of claim 1, wherein the first hook is connected at an interface of the planar surface and the heel end.

4. The apparatus of claim 1, further comprising two longitudinal sidewalls extending from the inclined plane, wherein the planar surface consists of each distal edge of the two longitudinal sidewalls.

5. The apparatus of claim 1, further comprising a raised reinforcement surrounding the hole.

6. An apparatus for hanging curtains adjacent a periphery of a window framing, comprising:

a wedge body extending between a heel end and a toe end;

the wedge body defined by an inclined surface and a planar surface opposing the inclined surface;

a first hook connected to the heel end, the first hook facing an upward direction while the inclined surface faces a downward direction, wherein the first hook is connected at an interface of the inclined surface and the heel end; and a second hook between the heel end and the toe end, the second hook facing the upward direction, and the second hook extending from the inclined surface; and two longitudinal sidewalls extending from the inclined plane, wherein the planar surface consists of each distal edge of the two longitudinal sidewalls.

7. The apparatus of claim 6, further comprising a hole between the heel end and the toe end, the hole communicating the planar surface and the inclined surface.

8. The apparatus of claim 7, further comprising a raised reinforcement surrounding the hole.

* * * * *